United States Patent [19]

Jacobsen

[11] 4,083,374

[45] Apr. 11, 1978

[54] SMOKING DEVICE

[76] Inventor: Evan L. Jacobsen, 434 N. Austin, Apt. 2E, Oak Park, Ill. 60302

[21] Appl. No.: 744,316

[22] Filed: Nov. 23, 1976

[51] Int. Cl.[2] ..... A24F 3/00; A24F 1/02

[52] U.S. Cl. ..... 131/178; 131/215 B

[58] Field of Search ..... 131/178, 206, 215 R, 131/215 A, 215 B, 223, 171 R, 170 R, 171 A, 173

[56] References Cited

U.S. PATENT DOCUMENTS

| | | | |
|---|---|---|---|
| 2,124,130 | 7/1938 | Deventer | 131/215 B |
| 2,986,146 | 5/1961 | Yao-Huangli | 131/215 B X |
| 3,209,764 | 10/1965 | Shih | 131/215 R |
| 3,705,590 | 12/1972 | Rains | 131/171 A X |
| 3,863,648 | 2/1975 | Cathey | 131/215 B X |

*Primary Examiner*—Stephen C. Pellegrino
*Attorney, Agent, or Firm*—Alter and Weiss

[57] ABSTRACT

An improved smoking device enabling the smoker to fill a bag with smoke at one end of the smoking device. The smoke is obtained from smoking materials, such as tobacco. The tobacco is loaded into the pipe and lit, when a valve in the smoking device is turned to a first position. In a second position the stem of the smoking device is coupled to the bag through the smoldering tobacco, enabling the smoker to blow the smoke into the bag. When the valve is in a third position, the stem of the smoking device is connected directly to the smoked filled bag. The smoker can thus inhale the smoke and exhale it back into the bag. The smoke is thereby reused many times and thus maximizes the utilization of flavor in the smoke, while minimizing pollution of the environment. A fourth position may be provided wherein the flame of a match or lighter is used to single clean screens.

13 Claims, 9 Drawing Figures

SMOKING DEVICE

This invention relates to smoking devices and more particularly, to a unique pipe-like smoking device utilizing a bag which the smoker fills with the smoke prior to inhaling.

Since man first took up smoking, he has continuously been varying the means and methods used in smoking to enhance the enjoyment obtained by inhaling smoke, while attenuating the adverse effects of the harshness brought on by heat and chemicals in the smoke. The search for new modes of smoking has been spurred on by the research which indicated beyond a reasonable doubt that smoking was a direct cause of cancer, and further, increases the probability of suffering from cardiovascular malfunction.

Among the attempted smoking improvements in the prior art devices are things such as the well known water pipe, wherein the smoke is bubbled through a container of water to both cool the smoke and filter it prior to the smoker's access to the smoke.

Among the problems inherent in water pipes are its relative lack of mobility and the difficulties involved in cleaning.

Other prior art attempts to improve the smoker's enjoyment and to minimize the adverse effects of smoking, such as the discomfort and danger caused by the heat and chemicals of the smoke, have been smoking devices, such as shown in U.S. Pat. Nos. 2,051,030; 2,830,397 and 3,705,590.

The U.S. Pat. No. 2,051,030 teaches methods and apparatus for purifying and cooling the smoke by the process of condensing, filtering, scrubing, washing and otherwise removing undesirable ingredients in the smoke, after which the scrubbed and washed smoke is forced into containers under pressure. The pressurized smoke is then utilized by the smoker in the containers which approximate the size and shape of a cigar, cigarette or pipe.

The U.S. Pat. No. 2,830,597 is also concerned with utilizing smoke filled containers for providing the smoker with smoke, rather than taking the smoke from a smoldering material.

The U.S. Pat. No. 3,705,590 concerns yet another device utilizing compressed tobacco smoke. It further includes means and methods for refilling a container containing the compressed tobacco smoke and a one-way valve to permit refreshing the case with fresh smoke, after the smoke is consumed.

All of the devices in these prior art patents teach the use of pressurized smoke filled containers. Thus, to provide the patented smoke filled containers requires relatively complicated equipment, such as compressors. Accordingly, the prior art has not provided a device wherein the smoker can efficiently fill a bag with smoke and subsequently use the smoke from the bag to satisfy his habit. Therefore, it is an object of the present invention to provide a new and unique smoking device.

It is a further object of the present invention to provide a smoking device which enables a smoker to use readily available smoking materials to fill a bag with the smoke and to utilize the smoke filled bag for a supply of smoke. In utilizing the bag for smoke, the smoke is more efficiently used since the smoker repeatedly can inhale the same smoke and return it back to the pipe until the smoke no longer provides him with the satisfaction normally obtained by the smoke.

Accordingly, yet another object of the present invention is to provide a smoking device which, when being used, does not contaminate the ambient environment with the normal residue left by smokers, such as exhaled smoke and ashes.

Still another object of the present invention is to provide a smoking device which can be used by the smoker to store the smoke obtained from the smoking material, such as tobacco, thereby providing the smoke for use at some future time.

A related object of the present invention is to provide a smoking device that enables transporting such stored smoke.

Still another object of the present invention is to provide a smoking device that automatically cools the smoke prior to the smoker's inhaling it.

Yet another object of the present invention is to provide a smoking device that is readily and easily cleaned.

A preferred embodiment of the present invention includes a main cylindrical body having a valve core therein. The main body has a stem extending from a side thereof. A mouthpiece on the stem enables the user of the improved smoking device to either blow into the main body or suck from the main body.

Extending approximately from the opposite side of the main body is a smoke bag coupling tube, which attaches a hollow container, such as a bag, to the main body.

The main body is loaded with smoking material, such as tobacco. The valve core, which has four basic positions, is in the first position. In that position the tobacco is also lit.

In the second valve core position, smoke from the lit tobacco is blown and forced into the smoking bag.

In a third position the smoker has access to the smoke in the smoke bag, but is denied access to the smoking material. Therefore, he can inhale the smoke from the smoke bag, exhale the smoke back to the smoke bag, continuously until all of the flavor of the smoke in the smoke bag is diminished beyond the point of enjoyment.

Thus, the smoker makes more efficient use of the smoking material, reprocessing the smoke. The smoke is kept cooler than smoke that is taken directly from the smoldering smoking material, thereby reducing the harshness and avoiding some of the irritating effects which have been found to cause cancer.

The smoke may be left in the smoking bag if the user is engaged in some other activity, which precludes his smoking at the time. The use of the improved smoking device maximizes enjoyment and minimizes odor in the room, as well as other adverse effects normally present with smoking devices.

The improved smoking device has a fourth position wherein the user can fire clean a filter screen through which the smoke is forced into the smoking bag. This position is one of the items which renders the improved smoking device easily cleaned.

These and other objects and features of the invention will be best understood by making reference to the following figures and descriptions, wherein.

Figure 1:
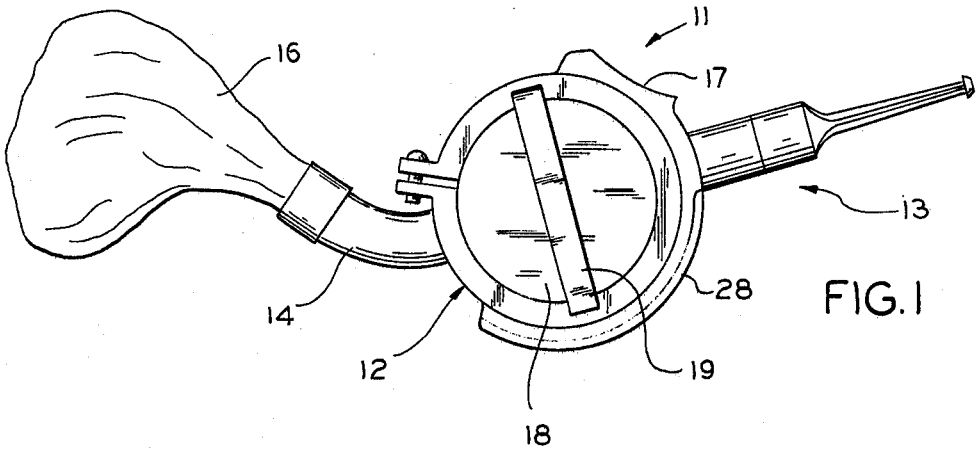
FIG. 1 is a side view of an assembled improved smoking device.

As seen in FIG. 1 the improved smoking device 11 includes a main body 12 preferably hollow and cylindrically shaped. Extending from the main body 12 is a pipe stem 13. A smoke bag tube 14 having a smoke bag 16 attached thereto also extends from the main body and is removed from the stem by approximately 180°.

The main body 12 is shown having a loading funnel 17 at a portion of the top side of the main body proximate to the extending stem. One side of the main body 12 is provided by a control handle means 18 having a control handle 19 extending therefrom.

The stem 13 is comprised of a mouthpiece 21 which fits into a mouthpiece tube 22, in any well known manner. A filter 23 may be provided for final filtering the smoke as it passes from the mouthpiece tube through the mouthpiece to the smoker.

Figure 2:
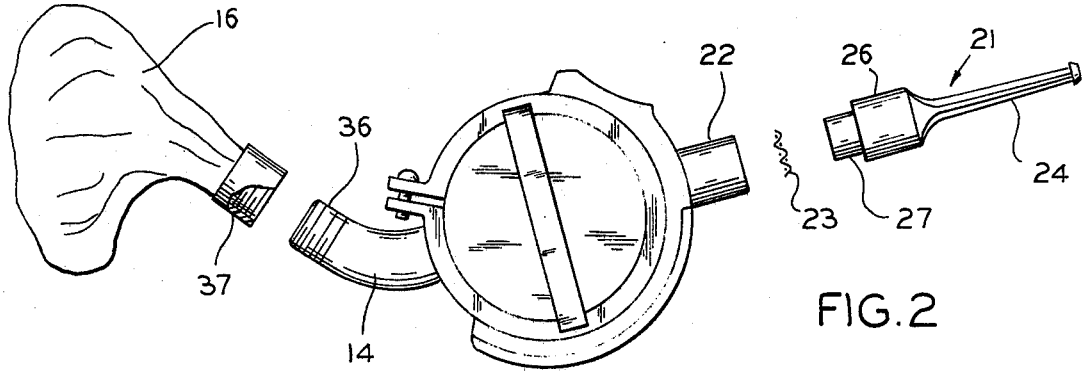
FIG. 2 is the side view of FIG. 1 showing the mouthpiece and the smoking bag disconnected from the main body to enhance the mobility of the smoking device.

As shown in FIG. 2, the mouthpiece 21 has a mouth extending relatively flat portion 24, a larger cylindrical portion 26, followed by a smaller cylindrical portion 27. The smaller cylindrical portion 27 is dimensioned to press fit into the inner periphery of mouthpiece tube 22.

Figure 8:
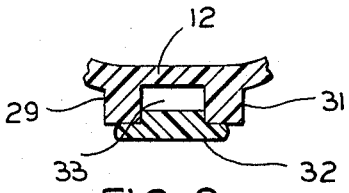
FIG. 8 is a partial sectional view of the trough passage, when looking in the direction of the arrow 8—8 in FIG. 4.

Extending approximately from the funnel 17 along the bottom of the main body 12 is a trough section 28. The trough section, as best seen in the cross section of FIG. 8, comprises a pair of outwardly extending walls 29 and 31. Press fitted between the walls is a sealing unit 32. A space 33 is left between the sealing unit 32 and the bottom of the main body 12. This space extends from an opening in the wall of the main body 12 to an opening in the mouthpiece tube 22.

The sealing unit 32, which in one preferred embodiment is a characterized resilient strip, is readily removed to clean the trough described by the spaced apart extending walls 29, 31, the main body 12 and the strip 32. The location of the trough created by the seal 32, in addition to providing a passageway, enables it to catch and trap tars and resins generated by the smoldering, smoking material. The removable strip seal 32 facilitates cleaning the trough section 33.

The smoke bag tube 14 is equipped with means for readily coupling the smoking bag 16 thereto. As shown, for example, in FIG. 2, the smoke bag tube 14 may be threaded at its ends 36. The smoke bag 16 is also shown with female thread 37 for conveniently connecting the smoke bag 16 to the smoke bag tube 14.

In the use of the improved smoking device the smoke bag 16 is coupled to the smoke bag tube 14, and the mouthpiece 21 is connected to the mouthpiece tube 22. The bag and mouthpiece are removed for transporting the unique improved smoking device in the user's pocket or purse.

Figure 3:
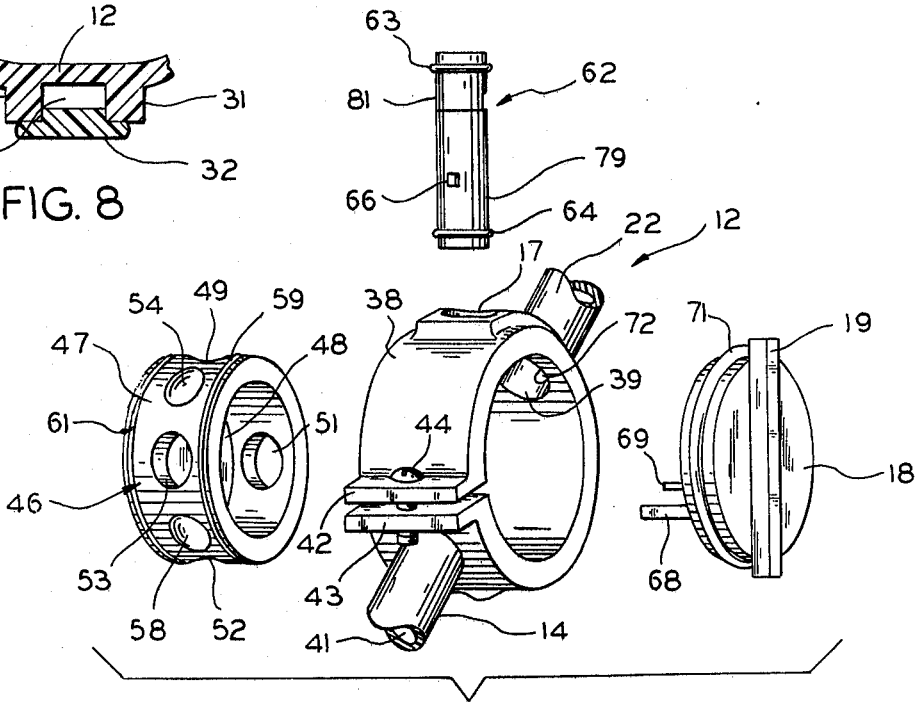
FIG. 3 is an exploded view of the main body and valve components.

As best seen in FIG. 3, the main body 12 is a hollow cylindrical section having a peripheral wall 38. The loading funnel 17 is a funnel-like aperture extending through the peripheral wall 38. The mouthpiece tube 22 extends from an aperture 39 which also penetrates peripheral wall 38. The smoking bag 14 similarly surrounds an aperture 41 extending through the peripheral wall 38.

Means are provided for adjusting the diameter of the peripheral walls 38. More particularly, the peripheral walls 38 terminate in radially extending spaced apart flanges 42 and 43. The spacing between the flanges is adjusted by threaded fastener means, such as screw 44. The screw 44 extends through a non-tapped aperture in flange 42 into a tapped aperture in flange 43 so that turning the screw in a clock-wise direction, for example, diminishes the distance between flanges 42 and 43; turning the screw in the opposite direction increases the distance between flanges 42 and 43, thereby varying the diameter defined by peripheral walls 38. The capability of varying the diameter compensates for variations in the outer diameter of valve core 46, due to heat and the like, which fits into the main body 12.

The valve core section 46 also has cylindrical walls 47 closed on one side 48 and open on the other side. Four oppositely disposed apertures 49, 51, 52 and 53 each approximately 90° apart are located in the walls 47 of the valve core 46. Between the apertures are four resin traps 54, 56, 57 and 58. The four resin traps are shown as circular indentations on the outside of cylindrical wall 47. In FIG. 3 only indentations 54 and 58 are visible.

The valve core 46 fits into the hollow cylindrical body 12 defined by walls 38, and the apertures in the valve core enable a passageway to be completed between the pipe stem 13 and the smoke bag 16. Means are provided for sealing the valve core in the body 12; that is, means such as U-cup seals 59, 61, to retain smoke within the improved smoking device.

Means are provided for receiving and/or transporting the smoking material, such as tobacco. More particularly, cartridge 62 is provided, which is designed to extend from one aperture to the valve core to the oppositely disposed aperture. Thus, for example, the cartridge 62 is dimensioned to pass through apertures 53 and extend between aperture 53 and 51. Cartridge sealing devices, such as O-ring 63 and 64, are provided to maintain the integrity of the cartridge seal and insure that the smoke is trapped within the smoking device cartridge. Any other sealing means may be used.

Means are provided for enabling removal of the cartridge from the smoking device. More particularly, nipples 66 and 67 are integral to the walls of the cartridge and extend therefrom to enable gripping the cartridge for forcing it from the smoking device. The cartridge is loaded into the smoking device through loading funnel 17, when the core is positioned so that a pair of oppositely disposed apertures, such as apertures 51 and 53, are aligned with the loading funnel aperture.

The control means 18 is shown having a pair of tines extending therefrom to abut one side of the nipples 66 and 67 so that when the control handle is pressed downward, the tines 68 and 69 push up against the nipples 66 and 67 thereby forcing the cartridge 62 out through the funnel. A pivot point to enable forcing the tines against the nipples is provided by the seal means 71 located around the periphery of the control means. The control means 18 controls the position of the valve core by the use of a key and keyway or any other well known interlocking arrangement, and therefore, controls the precise function of the smoking device.

Figure 5:
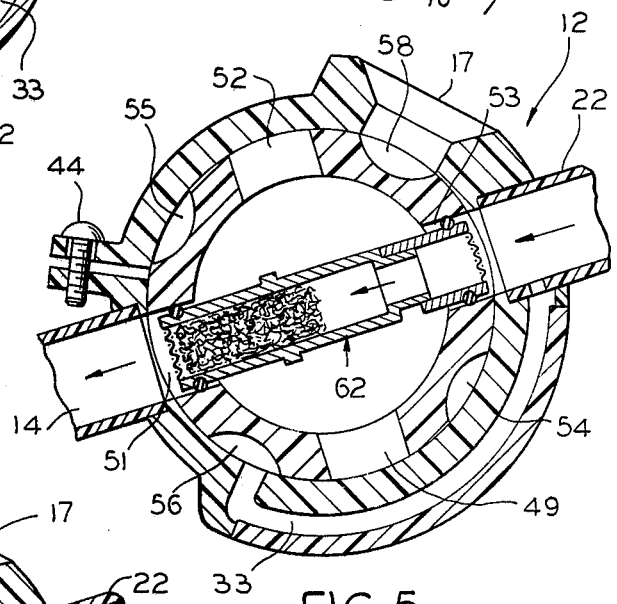
Figure 6:
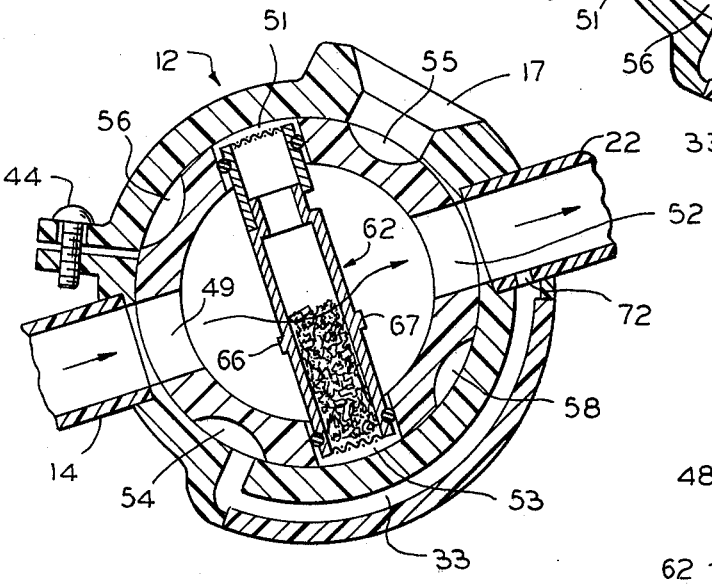
Figure 7:
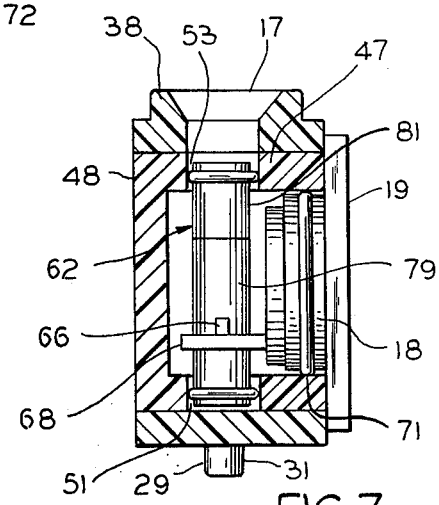
FIG. 7 is a sectional plan view showing the position of the control handle in relationship to the main body valve stem and smoking material cartridge.

Turning the handle 19 forces tines 68 and 69 against the body of the cartridge 62 which in turn places a force on the inner circumference of the apertures, such as apertures 51 and 53, to rotate valve core 46. The different positions of the valve core and the precise effects on the smoking device are shown in FIGS. 4–6.

Figure 4:
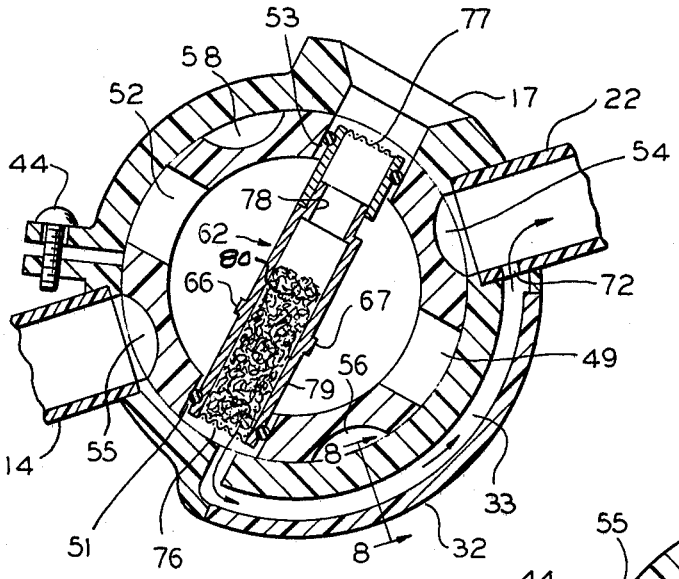
FIGS. 4–6 are sectional views showing the different positions of the valve core when the improved smoking device is in use.
Figure 9:
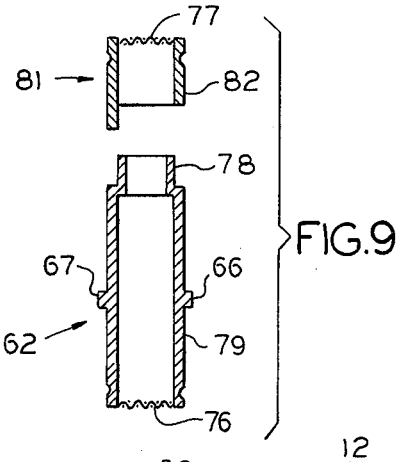
FIG. 9 is a cross-sectional exploded view of a smoking material container for use with the improved smoking device.

FIG. 4 illustrates a first position — the loading and lighting position of the improved smoking device. The apertures on the valve core, such as apertures 51 and 53 are aligned with the aperture of the loading funnel 17 enabling loading the cartridge 62 into the smoking device. The cartridge can be preloaded with smoking material or can be loaded with smoking material when placed in the smoking device as will be explained.

Once the cartridge is in place and loaded with tobacco, the smoking material in the cartridge can be lit, when air is drawn from funnel 17 through the smoking material 80 and trough 33 and aperture 72 in mouthpiece tube 22.

At this time it should be noted that the apertures 49 and 52 of core 46 are blocked by the inside of the inner periphery of cylindrical walls making up main body 12. Similarly, the main apertures of the smoking bag tube 14 and the mouthpiece tube 22 are connected into indentation traps, such as indentation traps 54 and 55, respectively; and thus, are blocked. The other indentation traps 56 and 58 are adjacent to the inner periphery of the main body.

In the second position shown in FIG. 5, apertures 51 and 53 are aligned with tubes 22 and 14 so that the user of the device by blowing through the stem forces smoke into bag 16. At this time the funnel 17 is blocked by indentation 58 and the connection to trough 33 is blocked by indentation 56. Indentations 54 and 55 merely abut the inner periphery of the main body 12. The apertures 49 and 52 are similarly blocked by the inner periphery of the main body.

In the third position shown in FIG. 5, the apertures 49 and 52 are aligned with the smoke bag tube and the stem, respectively; thus, a passage is provided leading from the smoke bag to the stem through the hollow portion of the core. The cartridge 62 at this time has its ends juxtaposed to the surface of the inner periphery of the main body 12 through apertures 51 and 53.

The indentation 55 is now aligned with funnel 17. The indentation 54 is aligned with trough 33; thus, blocking that trough and assuring that it does not bleed any air or smoke through aperture 72 in the stem 22. The indentations 56 and 58 merely abut the inner periphery of the main body 12.

Thus, in this position of the core, the smoker inhales and exhales the smoke from the smoking bag through the smoking device. The smoking material in the cartridge is in the main line of flow.

In a fourth position, not shown, the cartridge is displaced 180° from its showing in FIG. 4. In this position aperture 51 is aligned and juxtaposed to funnel 17, while aperture 53 is aligned and juxtaposed to the trough 33. The apertures 49 and 52 are displaced 180° and the indentations also are all displaced 180°. In this position, of course, the bottom screen 76 can be fire cleaned. In the first position, the top screen 77 is in position to be fire cleaned.

The make up of the cartridge is readily seen in FIGS. 4–7. The cartridge actually combines a pair of telescoping parts each terminating in a screen. Thus, the portion 78 of the main cartridge body 79 has a slightly smaller outer diameter than the inner diameter of the cap cartridge body 81. Thus, cap cartridge 81 fits directly onto cartridge portion 78. A section 82 of cap cartridge body 81 is shorter than the remainder of the cap. This facilitates removing the cap 81 from the main body 79.

In practice the main cartridge body 79 is filled with smoking material, and then cap cartridge 81 is pressed onto portion 78. Alternatively, the cartridge body 79, without the cap, may be inserted in the funnel 17 and then loaded with smoking material.

While the principles of the invention have been described above in connection with specific apparatus and applications it is to be understood that this description is made by way of example only and not as a limitation on the scope of the invention.

I claim:

1. An improved smoking device enabling the smoker to fill a container with smoke and use the smoke in the container to satisfy the smoker's habit, said device including a main body section, means for receiving smoking material in said main body section, stem means extending from said main body section to provide the smoker access to the main body section for smoking purposes, tube means for coupling said smoke container to said main body section, and selecting means in said main body for selectively connecting said stem to either said smoking material, said smoke container through said smoking material, or said smoke container without going through said smoking material, whereby said smoker can light said smoking material, blow smoke from said lit and smoldering smoking material into said smoke container and inhale and exhale smoke from said smoke container, respectively.

2. The improved smoking device of claim 1 wherein said main body section comprises an open hollow cylinder with said stem means and said tube means extending outwardly therefrom, said selecting means insertable from either the right or left hand side of said open hollow cylinder, and stem and tube apertures extending through the wall of said main body section aligned with said stem means and with said tube, respectively.

3. The improved smoking device of claim 2 wherein said means for receiving smoking material in said main body section comprises a funnel aperture extending through the wall of the hollow cylinder, holding means fitting through said aperture for holding said smoking material, trough aperture means extending through said wall displaced from said funnel aperture for receiving said holding means, and trough means connecting said trough aperture to said stem to enable said smoker to force air through said smoking material for lighting purposes.

4. The improved device of claim 3 wherein means are provided for varying the diameter of said hollow cylinder section.

5. The improved smoking device of claim 3 wherein said selecting means comprises valve core means, and wherein said valve core means includes four passageways, a first and second passageway for use in said first position for coupling said stem to said funnel aperture in a first position, and for coupling said stem to said smoke container through said lit smoke material in a second position, and a third and fourth passageway for coupling said stem to said smoke container independently of said smoke material in a third position.

6. The improved smoking device of claim 5 wherein said valve core means includes at least one indentation on the periphery thereof abutting the inner periphery of said cylindrical section for trapping tars and resins therein to facilitate cleaning said improved smoking device.

7. The improved smoking device of claim 6 wherein said smoking device comprises a plastic bag, means for removably coupling said bag to said tube means, and wherein said stem means includes a removable mouthpiece whereby said improved smoking device is easily transported.

8. The improved smoking device of claim 6 wherein said valve core means comprises a hollow cylinder closed at one end, control means closing the other end, said control means including handle means for turning said valve core means.

9. The improved smoking device of claim 8 wherein said smoking material's holding means comprises a cartridge, said cartridge including a first body section, said first body section terminating at one end in a first screen means, telescoping cap means fitting over the other end of said first body section, said cap means terminating in a second screen means, means for facilitating the removal of said cap means from said first body section, said cartridge means dimensioned to fit between the first and second passageways of said valve core, tines on said control means fitting on opposite sides of said cartridge means, and nipple means extending from said first body section of said cartridge to abut said tines, whereby when said tines are forced toward said funnel aperture said cartridge is forced out of said funnel aperture.

10. The improved smoking device of claim 2 wherein said trough means includes removable seal means for facilitating cleaning.

11. The improved smoking device of claim 1 wherein said selecting means comprises valve core means, said valve core means having at least three positions; a first position for lighting said smoking material, a second position for blowing smoke from said lit smoking material into said smoke container and a third position for enabling inhaling and exhaling smoke from said smoke container independent of said lit smoking material.

12. An improved smoking process including the steps of:

(a) holding a flame near smoking material;

(b) forcing air passed said smoking material to light said smoking material;

(c) forcing air through said lit smoking material toward a smoke container to force smoke into said smoke container; and (d) inhaling and exhaling the smoke from said smoke container without causing air to pass through the smoking material.

13. The improved smoking process of claim 12 wherein said smoking material is held in a tube having two open ends including the steps of:

holding the flame near one of the two open ends of said tube at the opening of said smoke container;

moving the tube into alignment with the smoke container;

thereafter forcing air through said tube toward said smoke container to force smoke in the smoke container; and moving the tube out of alignment with said smoke container and positioning it so that inhaling and exhaling smoke from the smoke container will not cause air to pass through the smoking material.

* * * * *

UNITED STATES PATENT AND TRADEMARK OFFICE

CERTIFICATE OF CORRECTION

PATENT NO. : 4,083,374

DATED : April 11, 1978

INVENTOR(S) : Evan L. Jacobsen

It is certified that error appears in the above-identified patent and that said Letters Patent are hereby corrected as shown below:

| | |
|---|---|
| Last Line of Abstract | Cancel "single" insert instead -- singe -- |
| Col. 6, line 57 | Insert--smoking--after "improved" |

Signed and Sealed this

Fifth Day of September 1978

[SEAL]

Attest:

RUTH C. MASON
*Attesting Officer*

DONALD W. BANNER
*Commissioner of Patents and Trademarks*